United States Patent [19]

Arai et al.

[11] 4,068,378

[45] Jan. 17, 1978

[54] PORTABLE CHAIN SAW

[75] Inventors: Tashiro Arai; Masaaki Sato; Eiji Kobayashi, all of Tokyo, Japan

[73] Assignee: Nippon Kuatsu System Co., Ltd., Tokyo, Japan

[21] Appl. No.: 699,136

[22] Filed: June 23, 1976

[30] Foreign Application Priority Data

| | | |
|---|---|---|
| June 26, 1975 | Japan | 50-88751[U] |
| Nov. 28, 1975 | Japan | 50-160092[U] |
| Dec. 5, 1975 | Japan | 50-162857[U] |

[51] Int. Cl.[2] ..... B27B 17/10

[52] U.S. Cl. ..... 30/382; 74/198

[58] Field of Search ..... 192/84 A; 74/198; 30/381, 382, 383, 384, 386, 387

[56] References Cited

U.S. PATENT DOCUMENTS

| | | | |
|---|---|---|---|
| 2,737,820 | 3/1956 | Collar | 74/198 |
| 3,167,673 | 1/1965 | Miguel | 192/84 A |
| 3,849,884 | 11/1974 | Arff | 30/383 |

FOREIGN PATENT DOCUMENTS

| | | | |
|---|---|---|---|
| 38,521 | 7/1957 | Poland | 30/381 |

*Primary Examiner*—Jimmy C. Peters

*Attorney, Agent or Firm*—Frank J. Jordan

[57] ABSTRACT

The present invention relates to improvements in a portable chain saw wherein power of a power device like a motor separated from the body of the chain saw is transmitted to a driving means of the chain saw by way of a flexible shaft, thus the body of the chain saw being small-sized and lighter at weight. Further, in the portable chain saw body an overload protection means is provided preceding to means transmitting power to a driving roller for driving a chain cutter so that no more power than a predetermined load is transmitted to a driving means of the chain saw and only power of the predetermined load is done thereto.

9 Claims, 6 Drawing Figures

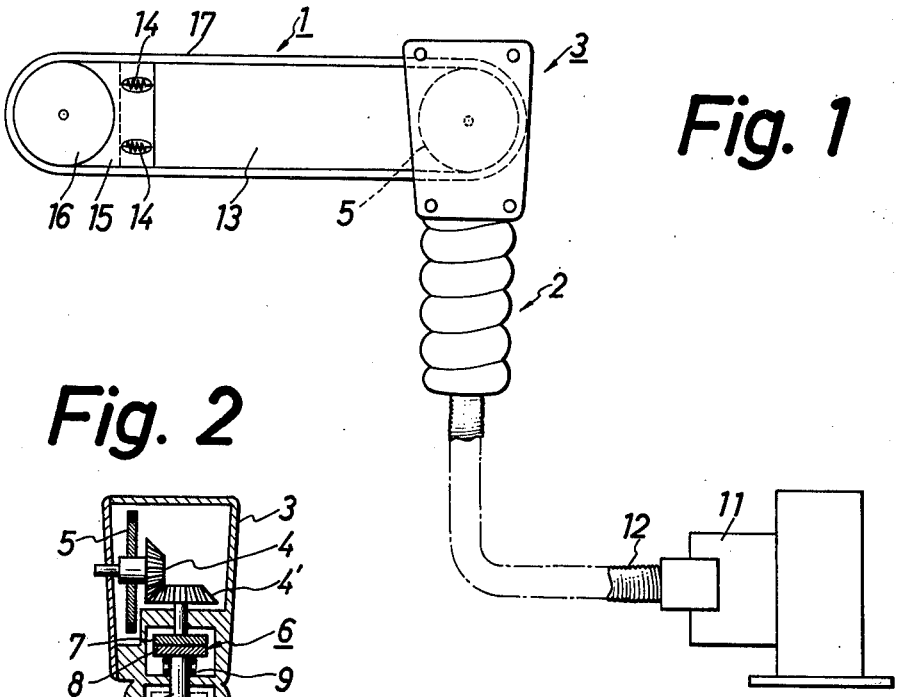
Fig. 1
Fig. 2
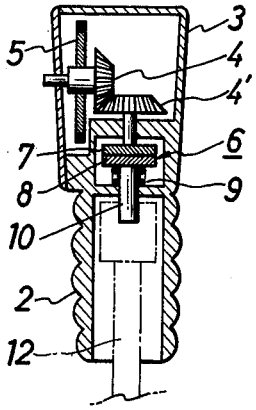
Fig. 6
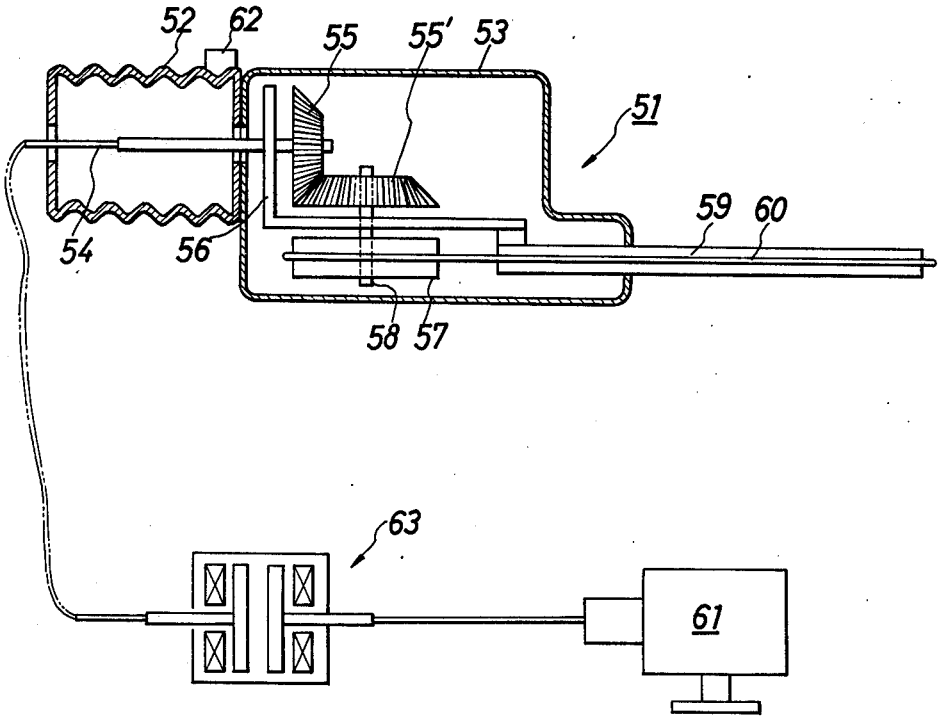

PORTABLE CHAIN SAW

BACKGROUND OF THE INVENTION

Conventionally, a chain saw for cutting trees or timbers is provided with a loop-type chain cutter stretched between a driving roller to be driven by a motor and an idle pulley. Particularly, a conventional type of chain saw body is large-sized because of incorporating thereinto a motor as an integral device. In addition, when overload is applied to the chain cutter, there is a growing danger that the chain cutter or the chain saw body may be damaged. Further, the disadvantage is that a conventional type of chain saw is not available for cutting smaller trees or the like because of such a large-sized device. In order to remove the aforegoing disadvantages, the present invention has been achieved.

BRIEF SUMMARY OF THE INVENTION

An object of the invention is to provide a portable chain saw wherein power of a power device like a motor separated from the body of the chain saw is transmitted to a driving means of the chain saw by way of a flexible shaft, thus the body of the chain saw being small-sized and lighter at weight.

Another object of the invention is to provide to a portable chain saw wherein an overload protection means is provided preceding to means transmitting power to a driving roller for driving a chain cutter so that no more power than a predetermined load is transmitted to a driving means of the chain saw and only power of the predetermined load is done thereto.

Another object of the invention is to provide a portable chain saw wherein accidents such as breakage of a chain cutter of the body of the chain saw being occurred due to overload can be removed owing to an overload protection means.

Another object of the invention is to provide to a portable chain saw of which structure is as a whole simplified, since driving power is transmitted by way of a flexible shaft.

Another object of the invention is to provide to a portable chain saw which can be used at home because of its handy device and easy operation.

Still a further object of the invention is to provide a portable chain saw which can be manufactured with less costs.

Other features and advantages of the invention will be apparent from the following description taken in connection with the accompanying drawings.

BRIEF DESCRIPTION OF THE DRAWINGS

FIG. 1 is a detail front view of the first embodiment of a portable chain saw according to the invention.

FIG. 2 is a sectional side view of interior construction of the portable chain saw of FIG. 1.

FIG. 6 is a detail plan view of the third embodiment of a portable chain saw according to the invention.

DETAILED DESCRIPTION OF THE INVENTION

First Embodiment

Figure 3:
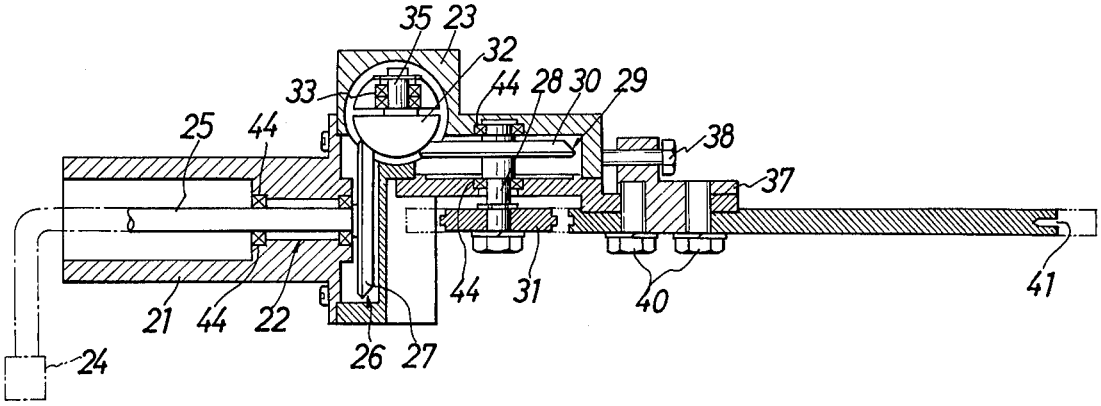
FIG. 3 is a transverse sectional plan view of the second embodiment of a portable chain saw according to the invention.

Referring to FIG. 1, numeral 1 is a portable chain saw according to the present invention. In a body 3 of the chain saw 1 under which is formed a hollow cylindrical grip 2 there are provided a pair of bevel gears 4,4', two of which are engaged with each other at an angle of 90°, thus being rotated with each other. A rod of a bevel gear 4 being rotated in a horizontal direction of the rod is fixed with a driving roller 5, while a rod of the bevel gear 4' being rotated in a vertical direction is fixed with an overload protection means 6. As regards the function of the overload protection means 6, under the condition that no more load torque than the predetermined rate is applied to the bevel gear 4', power can be transmitted. If more load torque than the predetermined rate is applied, power can no longer be transmitted.

The overload protecting means 6 comprises a first disc 7 fixed with the bevel gear 4' by way of a rod, a second disc 8 closely contacted the first disc 7 and subsequently rotated by the friction force of the first disc 7 and a coil spring 9 capable of pressing both the first and second discs 7, 8 with elastic stress. Instead of using the discs 7, 8 and the spring 9, a known magnetic clutch or the like can be utilized. Its embodiment is shown in FIG. 6.

A shaft 10 formed integrally with the second disc 8 is incorporated in the grip 2. The shaft 10 is connected to a flexible shaft 12 which can transmit output of a power device like a motor 11 having a preferred torque which is separated from the chain saw body 3. Due to driving of the power device 11, the driving roller 5 is rotated with a fixed torque.

In the body 3 there are formed the grip 2 and the first guide plate 13 in a crosswise direction of which end side is linked with the second plate 15 by way of a plurality of buffer springs 14. And an idle pully 16 is rotatably fixed with the underside of the second guide plate 15. And a known loop-type chain cutter 17 is stretched between the idle pully 16 and the driving roller 5.

The operational function of the chain saw of the aforegoing structure will now be described. The chain cutter 17 can be mounted very easily by retracting the second guide plate 15 toward the first guiding plate 13 by means of buffer springs 14. In addition, owing to the buffer springs 14 a preferred tension is applied to the driven pulley 16.

When the power device 11 causing torque is switched on, power is transmitted to the shaft 10 of the overload protection means by way of the flexible shaft 12. Subsequently, power is transferred from the second disc 8 fixed with the shaft 10 to the first disc 7. Thus, due to the rotation of the bevel gears 4, 4', the driving roller 5 linked with the bevel gear 4 is rotated with a fixed torque, and the chain cutter 17 is rotated with a given high speed along the driving roller 5 and the idle pulley 16 as well, by which trees or timbers can be cut off easily. (The cutting view is not shown in the drawings.) There is the possibility that a tree or the like is not cut off by the chair cutter 17 due to overload. Then, an abnormal overload torque is applied to the first disc 7 by way of the bevel gear 4, 4'. In case the abnormal torque is over the predetermined torque, that is over the ratio to be controlled by elasticity of the coil spring 9 and friction force as well, power is not transmitted to the flexible shaft 12, since there takes place slipping between the first disc 7 and the second disc 8.

Accordingly, the chain cutter 17 itself or the body 3 is previously protected from an abnormal overload torque, and is not damaged owing to the foregoing arrangement of the overload protecting means 6.

Second Embodiment

Figure 4:
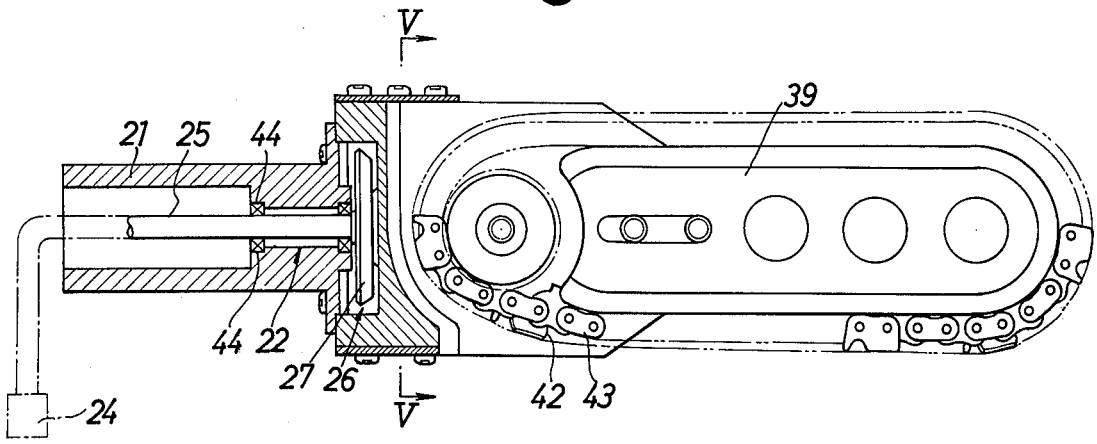
FIG. 4 is a vertical sectional front view of the second embodiment in FIG. 3.
Figure 5:
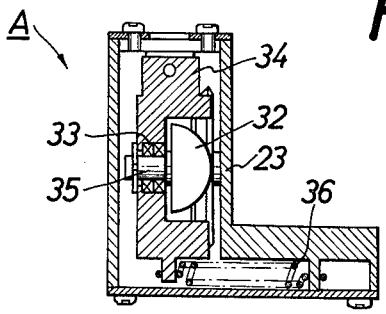
FIG. 5 is a vertical section of a non-stage variable speed power transmission means in the second embodiment in FIGS. 3 to 4.

We refer to the second embodiment of a portable chain saw according to the present invention which is illustrated in FIGS. 3 to 5. In the second embodiment of the chain saw in which a power device and a chain saw body are separated from each other, and are connected together by way of a flexible shaft or the like, power is transmitted to a chain cutter by a non-stage variable speed power transmission means A so that the rotation ratio can be set optionally, and simultaneously in case overload is applied, it is removed by the non-stage variable speed power transmission means so as to protect the chain cutter or the power device from overload.

Further, another aspect of the second embodiment is that a grip is coaxially linked with a chain cutter body. Accordingly, this arrangement becomes more convenient in use.

Referring to FIG. 3, numeral 21 is a grip in which are formed two holes 22. A flexible shaft 25 extending inside the grip 21 is connected to a driving shaft of a power source 24 such as a motor or an engine for agricultural use. And an end of the flexible shaft 25 is fixed with a friction driving wheel 27, two side ends of which are of tapered shape 26. The driving friction wheel 27 is rotated by the rotation of the flexible shaft 25.

In the case 23 there is provided a rotatable shaft 28 which is intersecting with a central axis of the flexible shaft 25, and an end of the rotatable shaft 28 is passing through the case 23. And an idle friction wheel 30 of which side ends are of tapered face 29 is crosswisely fixed with the rotatable shaft 28. An outwardly extending part of the rotatable shaft 28 is fixed with a gear pulley 31. And a rotatable hemisphere 32 is mounted on and contacted forcibly with the tapered faces 26, 29 of the friction driving wheel 27 and the idle friction wheel 30 respectively.

As shown in the vertical section of FIG. 5, in the case 23 there is rotatably mounted a movable member 34 in which are provided a plurality of bearings with which is supported a shaft 35 secured to the underside of the hemisphere 32. Further, an end of the movable member 34 is urged by a coil spring 36. Due to elasticity of the spring 36, the hemisphere 32 is pressed to the tapered faces 26 and 29. In the non-stage variable speed power transmissing means A mentioned above, by changing an angle of axis of the hemisphere 22, the rotation ratio of both friction wheels 27, 30 is variable continuously or with non-stage. In this embodiment the angle of the shaft 35 is previously set.

An end of the case 23 is linked rotatably with a sliding member 37 into which is passing a regulating screw 38. Further, the sliding member 37 is fixed by two screws in order to fix an oval-type guide plate 39.

Numeral 41 is a guide channel which is coaxially adjacent to the gear pulley 31, and in which is incorporated a chain cutter 43. The chain cutter 43 having a cutter 42 is stretched along the periphery of the oval-type guide plate 42 so as to engage with the gear pulley 31. Numeral 44 is bearing.

The operational function of the chain saw according to the second embodiment will now be described. When the power device 24 is driven, power is transmitted to the friction driving wheel 27 by way of the flexible shaft 25. Then, the rotated friction driving wheel 27 rotates the hemisphere 32 by way of the rotated tapered face 26 of the friction drive 27 contacted with the hemisphere 32. Subsequently, the axially rotated hemisphere 32 rotates the tapered face 29 of the idle friction wheel 30 contacted with the hemisphere 32. Then, the rotatable shaft 28 fixed with the idle friction wheel 30, and the gear pulley 31 fixed with the shaft 28 are rotated by the rotation ratio predetermined by the angle of axis of the hemisphere 32.

Consequently, the chain cutter 43 stretched along the oval-type guide plate 42 is rotated by the gear pulley 31. When the chain cutter 43 is attached to a tree or a timber, it can be cut off very easy.

At the time of overload when a tree or a timber can not be cut off by the chain cutter 43, both the chain cutter 43 and the idle friction wheel 30 stop, while both the flexible shaft 25 and the friction driving wheel 27 are still rotated. However, since the hemisphere 32 is pressed by the coil spring 36 toward both the friction wheels 27 and 30, the tapered faces 26, 29 thereof are slipped on the hemisphere 32. As a result, power is not transmitted from the friction driving wheel 27 to the idle friction wheel 30. Accordingly, the chain cutter 43 is not damaged by overload and no overload can be applied to the flexible shaft 25.

When it is required to apply a given tension to the stretched chain cutter 43, the screws 40 and the regulating screw 38 are to be released. Subsequently, the sliding member 37 is kept away from the gear pulley 31. Further, it is available to adjust optionally rotation ratio of both friction wheels 27, 30.

Third Embodiment

The third embodiment of a portable chain saw according to the present invention will now be described with reference to FIG. 6.

Numeral 51 is a chain saw body. Numeral 52 is a grip which is fixed with a case 53. A flexible shaft 54 passing inside of the grip 52 is connected to a driving bevel gear 55 supported by a frame 56. An idle bevel gear 55' engaged with the driving bevel gear 55, and a driving pulley are fixed with a rotatable shaft 58 which is also supported by a frame 56. An end of the frame 56 is fixed with an oval-type guide plate 59. The driving wheel 57 and the guide plate 29 are positioned axially. And a chain cutter 60 is rotatably stretched between the driving pulley 57 and the guide plate 59.

A power device 61 such as a motor or an engine for agricultural use is separated from the chain saw body 51. An operating switch 62 is mounted on the side of the grip 62.

On the other hand, a driving shaft of the power device 61 is connected to a magnetic clutch 63 of which power source is not shown in the drawing. And an output shaft of the magnetic clutch 63 is connected to the flexible shaft 54. Accordingly, a given torque of the power device 61 is transmitted to the driving bevel gear 55 by way of the magnetic clutch and the flexible shaft 54 as well. At the same time, the magnetic clutch performs the function of an overload protection means as well as of a power transmission means.

Referring to the operation of the chain saw of the third embodiment, the power source 61 is first driven, and subsequently the operating switch 62 of the grip 52 is switched on. Then, the magnetic clutch 63 is driven, and a given torque of the power device 61 is transmitted to the driving bevel gear 55 by way of the magnetic clutch 63 and the flexible shaft 54. Subsequently, an idle bevel gear 55' engaged with the driving bevel gear 55 and the driving pulley 57 are rotated with a given rotation ratio.

Accordingly, a chain cutter 60 stretched between the driving pulley 57 and the oval-type guide plate 59 are rotated with a given speed. Thus, trees or timbers or the like can be cut off very easily by this rotating chain cutter 60. Further, since the power device 61 is seperated from the chain saw body 51, vibration of the power device 61 is not transferred to the grip 52.

There is the possibility that a tree or the like is not cut off by the chain cutter 60 due to overload. At that time, the overload is applied to the driving pulley 57 and both the bevel gears 55, 55'. Simultaneously, the overload is applied to the magnetic clutch 63 by way of the flexible shaft 54. Then, the magnetic clutch 63 is slipped, so that no load is applied to the power device 61 and power transmission of the power device 61 is stopped. Accordingly, the chain cutter 61 stops.

In this way, the chain cutter 60, the bevel gears 55, 55' and the power source 61 are previously protected from overload and not damaged owing to the arrangement of the magnetic clutch 63.

As described previously, a body of the portable chain saw according to the present invention is separated from the corresponding power device, and the former is linked with the latter by way of a flexible shaft. As a result, the chain saw body becomes more small-sized and lighter at weight. Further, since there is mounted an overload protection means between the flexible shaft and a power transmission means, a chain cutter of the chain saw, and its body are previously protected from overload.

It is to be understand that the form of the present invention shown and described is to be taken as a preferred example of the same and that various changes in the shape, size, arrangement of parts may be resorted to without departing from the spirit of this invention or the scope of the subjoined claims.

What is claimed is:

1. A portable chain saw comprising a chain saw body, a power driven flexible shaft extending to said chain saw body, a chain saw cutter mounted on said chain saw body, and an overload protection means on said chain saw body interposed between said flexible shaft and said chain saw cutter such that the chain saw cutter is driven by said flexible shaft through said overload protection means, said overload protection means comprising a rotatable spherical member and a friction wheel operable to engage said rotatable spherical member, mounting means providing relative movement between said spherical member and said friction wheel, and biasing means urging said spherical member and friction wheel toward one another such that during normal load conditions power is transmitted through the frictional engagement between the spherical member and the friction wheel and upon encountering overload conditions, slippage occurs between the spherical member and the friction wheel to interrupt the power transmission.

2. A portable chain saw according to claim 1, wherein said mounting means comprises a member movably mounted in said chain saw body, bearing means rotatably mounting said spherical member on said movably mounted member, said biasing means being disposed between said movably mounted member and said chain saw body for urging said movably mounted member in a direction in which the spherical member engages said friction wheel.

3. A portable chain saw according to claim 1, wherein said friction wheel has a beveled and frustro conical peripheral surface engageable with said spherical member.

4. A portable chain saw according to claim 1, comprising a grip handle on said chain saw body, said flexible shaft extending through said grip handle, said flexible shaft being driven by a power source removed from said chain saw body and from said grip handle.

5. A portable chain saw according to claim 1, wherein said chain saw cutter is a closed loop chain, a driving pulley mounted on said chain saw body for driving said closed loop chain, said driving pulley being rotatable about an axis coincident with the axis of rotation of the friction wheel.

6. A portable chain saw according to claim 1, wherein said overload means comprises a second friction wheel in addition to the first said friction wheel, said second friction wheel engaging said rotatable spherical member to drive the latter, the first said friction wheel being driven by said spherical member.

7. A portable chain saw according to claim 6, wherein the first said friction wheel and the second friction wheel are mounted on said body for rotation about mutually perpendicular axes.

8. A portable chain saw according to claim 6, wherein a grip handle extends longitudinally from said chain saw body and has a longitudinal axis coincident with the axis of rotation of the second friction wheel.

9. A portable chain saw according to claim 6, comprising means connecting the first friction wheel to said chain saw cutter, and means connecting the second friction wheel to said flexible shaft.

* * * * *